US009752400B2

(12) United States Patent
Hazelip et al.

(10) Patent No.: US 9,752,400 B2
(45) Date of Patent: Sep. 5, 2017

(54) EXPANDABLE LINER HANGER WITH HIGH AXIAL LOAD CAPACITY

(71) Applicant: Halliburton Energy Services, Inc., Houston, TX (US)

(72) Inventors: Gary Lynn Hazelip, Frisco, TX (US); Sean Calahan, Katy, TX (US); Todd R. Agold, Garland, TX (US); Shane Furlong, Frisco, TX (US)

(73) Assignee: HALLIBURTON ENERGY SERVICES, INC., Houston, TX (US)

( * ) Notice: Subject to any disclaimer, the term of this patent is extended or adjusted under 35 U.S.C. 154(b) by 14 days.

(21) Appl. No.: 14/892,129

(22) PCT Filed: Jul. 22, 2013

(86) PCT No.: PCT/US2013/051542

§ 371 (c)(1),
(2) Date: Nov. 18, 2015

(87) PCT Pub. No.: WO2015/012799

PCT Pub. Date: Jan. 29, 2015

(65) Prior Publication Data

US 2016/0090801 A1 Mar. 31, 2016

(51) Int. Cl.

| | |
|---|---|
| ***E21B 23/01*** | (2006.01) |
| ***E21B 43/10*** | (2006.01) |
| ***E21B 33/04*** | (2006.01) |

(52) U.S. Cl.

CPC ..... *E21B 23/01* (2013.01); *E21B 33/0422* (2013.01); *E21B 43/10* (2013.01); *E21B 43/108* (2013.01)

(58) Field of Classification Search

CPC ..... E21B 23/01; E21B 33/0422; E21B 43/10; E21B 43/108

See application file for complete search history.

(56) References Cited

U.S. PATENT DOCUMENTS

| | | | | |
|---|---|---|---|---|
| 1,866,087 | A * | 7/1932 | Crowell | E21B 23/01 166/210 |
| 6,896,049 | B2 * | 5/2005 | Moyes | B21C 37/16 166/118 |
| 7,360,592 | B2 * | 4/2008 | McMahan | E21B 23/01 166/206 |
| 9,518,453 | B2 * | 12/2016 | Dilber | E21B 23/01 |

(Continued)

OTHER PUBLICATIONS

International Search Report and Written Opinion of the International Searching Authority/KR for International Application No. PCT/US2013/051542 dated Apr. 21, 2014, 10 pages.

*Primary Examiner* — James G Sayre
(74) *Attorney, Agent, or Firm* — Haynes and Boone LLP

(57) ABSTRACT

A high-axial load bearing assembly is provided for use with a radially expandable tool such as an expandable liner hanger. Exemplary embodiments of axial load bearing assemblies operate independently of external casing pressure and internal tubing pressure. The assemblies do not rely on movable slips or the physical characteristics of the sealing members to grip the casing and bear the axial load. The gripping and sealing functions are largely separated between gripping and sealing sub-assemblies. Hardened metal features which undergo radial expansion during deployment are provided with expansion stress-relief features.

19 Claims, 6 Drawing Sheets

(56) References Cited

U.S. PATENT DOCUMENTS

| | | | | |
|---|---|---|---|---|
| 2002/0030325 | A1* | 3/2002 | Gazewood | E21B 23/01 277/336 |
| 2002/0170709 | A1 | 11/2002 | Yokley | |
| 2004/0104031 | A1* | 6/2004 | Smith | E21B 43/103 166/382 |
| 2004/0149442 | A1* | 8/2004 | Mackenzie | E21B 43/105 166/297 |
| 2010/0089591 | A1 | 4/2010 | Thomson et al. | |
| 2012/0012305 | A1 | 1/2012 | Yokley | |
| 2015/0345249 | A1* | 12/2015 | Gorrara | E21B 33/127 166/387 |

* cited by examiner

EXPANDABLE LINER HANGER WITH HIGH AXIAL LOAD CAPACITY

CROSS-REFERENCE TO RELATED APPLICATIONS

None.

FIELD OF INVENTION

Methods and apparatus are presented for expandable liner hangers for use in subterranean wells, and more particularly, to methods and apparatus for an expanded liner hanger to grippingly and sealingly engaging a tubular, such as a casing, and providing support for high axial loads on the hanger.

BACKGROUND OF INVENTION

Oil and gas hydrocarbons are naturally occurring in some subterranean formations. A subterranean formation containing oil or gas is sometimes referred to as a reservoir. A reservoir may be located under land or off shore. Reservoirs are typically located in the range of a few hundred feet (shallow reservoirs) to a few tens of thousands of feet (ultra-deep reservoirs).

In order to produce hydrocarbons, a wellbore is drilled through a hydrocarbon-bearing zone in a reservoir. In a cased-hole wellbore or portion thereof, a casing is placed, and typically cemented, into the wellbore providing a tubular wall between the zone and the interior of the cased wellbore. A tubing string can then be run in and out of the casing. Similarly, tubing string can be run in an uncased wellbore or section of wellbore. As used herein, "tubing string" refers to a series of connected pipe sections, joints, screens, blanks, cross-over tools, downhole tools and the like, inserted into a wellbore, whether used for drilling, work-over, production, injection, completion, or other processes. Further, in many cases a tool can be run on a wireline or coiled tubing instead of a tubing string, as those of skill in the art will recognize. A wellbore can be or include vertical, deviated, and horizontal portions, and can be straight, curved, or branched.

During wellbore operations, it is typical to "hang" a liner onto a casing such that the liner supports an extended string of tubular below it. Expandable liner hangers are generally used to secure the liner within a previously set casing or liner string. Expandable liner hangers are "set" by expanding the liner hanger radially outward into gripping and sealing contact with the casing or liner string. For example, expandable liner hangers can be expanded by use of hydraulic pressure to drive an expanding cone, wedge, or "pig," through the liner hanger. Other methods can be used, such as mechanical swaging, explosive expansion, memory metal expansion, swellable material expansion, electromagnetic force-driven expansion, etc.

The expansion process is typically performed by means of a setting tool used to convey the liner hanger into the wellbore. The setting tool is interconnected between a work string (e.g., a tubular string made up of drill pipe or other segmented or continuous tubular elements) and the liner hanger. The setting tool expands the liner hanger into gripping and sealing engagement with the casing.

If the liner hanger is expanded using hydraulic pressure, the setting tool is generally used to control communication of fluid pressure and flow, such as between various portions of the liner hanger expansion mechanism and between the work string and the liner. The setting tool may also be used to control release of the work string from the liner hanger, for example, after expansion, in emergency situations, or after unsuccessful setting attempts. It is desirable to maintain a low equivalent circulating density (ECD), to minimize wall thickness of the setting tool and liner hanger assembly, so that the assembly can be conveyed rapidly into the well.

As can be appreciated, the expanded liner hanger must support the substantial weight of the attached tubing string below. For deep and extra-deep wells, subsea wells, etc., the tubing string places substantial axial load on the hanging mechanism grippingly engaging the liner hanger to the casing. There is a need for methods and apparatus providing an expandable liner hanger having a gripping mechanism and sealing mechanism capable of supporting the substantial axial loads imparted by today's longer and heavier liner strings.

BRIEF DESCRIPTION OF THE DRAWINGS

For a more complete understanding of the features and advantages of the present invention, reference is now made to the detailed description of the invention along with the accompanying figures in which corresponding numerals in the different figures refer to corresponding parts and in which.

Figure 1:
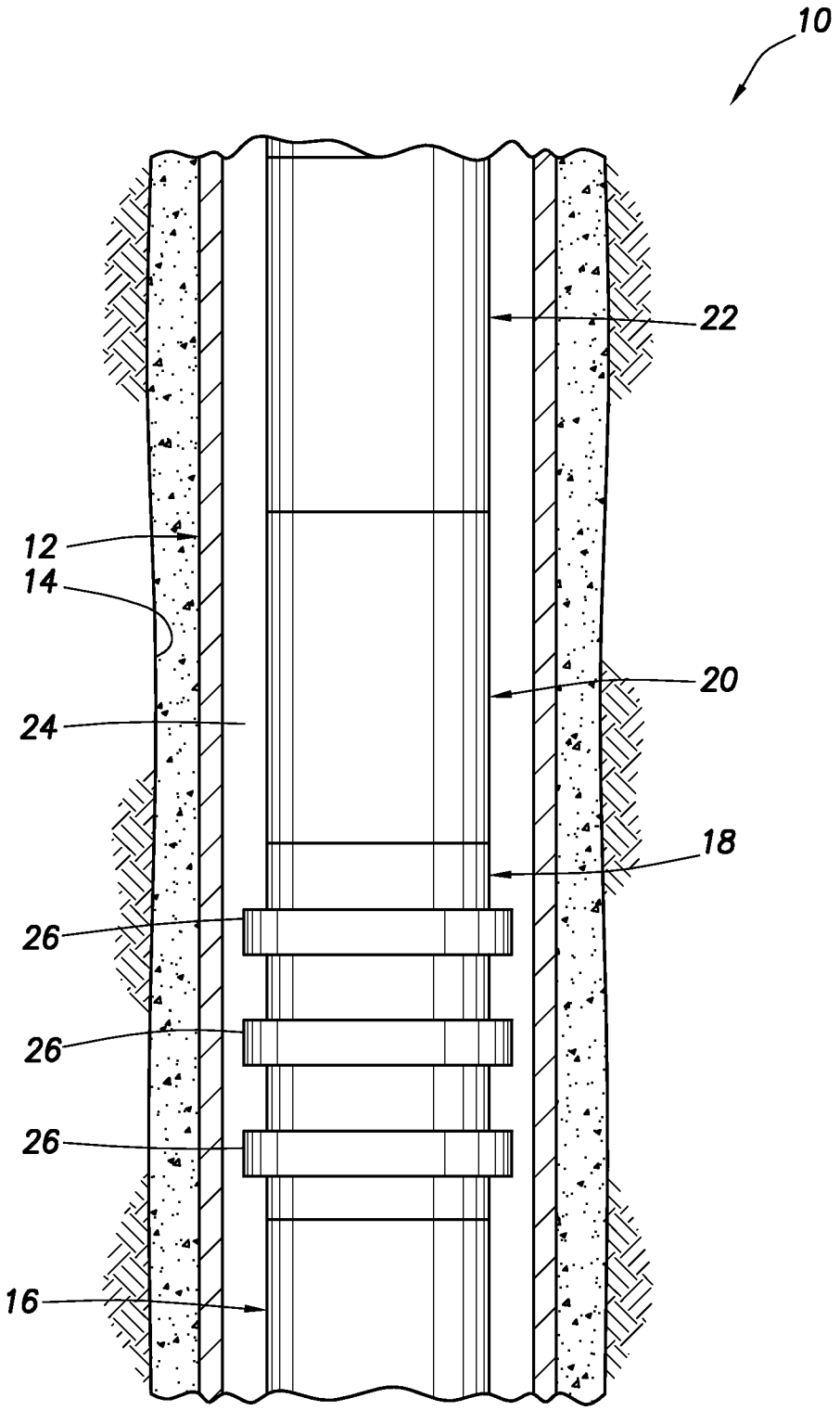
FIG. 1 is a schematic partially cross-sectional view of a liner hanger setting system and associated methods which embody principles of the present invention.

It should be understood by those skilled in the art that the use of directional terms such as above, below, upper, lower, upward, downward and the like are used in relation to the illustrative embodiments as they are depicted in the figures, the upward direction being toward the top of the corresponding figure and the downward direction being toward the bottom of the corresponding figure. Where this is not the case and a term is being used to indicate a required orientation, the Specification will state or make such clear.

DETAILED DESCRIPTION OF PREFERRED EMBODIMENTS

While the making and using of various embodiments of the present invention are discussed in detail below, a practitioner of the art will appreciate that the present invention provides applicable inventive concepts which can be embodied in a variety of specific contexts. The specific embodiments discussed herein are illustrative of specific ways to make and use the invention and do not limit the scope of the present invention.

The description is provided with reference to a vertical wellbore; however, the inventions disclosed herein can be used in horizontal, vertical or deviated wellbores.

As used herein, the words "comprise," "have," "include," and all grammatical variations thereof are each intended to have an open, non-limiting meaning that does not exclude additional elements or steps. It should be understood that, as used herein, "first," "second," "third," etc., are arbitrarily assigned, merely differentiate between two or more items, and do not indicate sequence. Furthermore, the use of the term "first" does not require a "second," etc. The terms "uphole," "downhole," and the like, refer to movement or direction closer and farther, respectively, from the wellhead, irrespective of whether used in reference to a vertical, horizontal or deviated borehole.

The terms "upstream" and "downstream" refer to the relative position or direction in relation to fluid flow, again irrespective of the borehole orientation. As used herein, "upward" and "downward" and the like are used to indicate relative position of parts, or relative direction or movement, typically in regard to the orientation of the Figures, and does not exclude similar relative position, direction or movement where the orientation in-use differs from the orientation in the Figures.

The embodiments focus on axial load bearing assemblies used in conjunction with an expandable liner hanger and present novel features for independently gripping and sealing the liner hanger (expanded) against the casing. The invention is not so limited; persons of skill in the art will recognize the usefulness of the invention and its teachings for use in gripping and sealing engagement between telescoped tubulars.

A purpose of the invention is to increase the axial load capacity of an expandable liner hanger in comparison to current designs. While some current designs use integral metal rings to trap elastomeric elements of varying length and number which in turn exert a post-expansion normal force on the adjacent casing to achieve axial load capacity, it is desirable to achieve a capacity less dependent upon the mechanical properties of the elastomeric seals, especially at elevated temperatures where such seals may yield, etc. Axial load bearing gripping and annular sealing functions are currently embodied in a single element. The proposed design separates these functions.

Many of the embodiments disclosed herein can be applied to various expandable liner hangers known in the art. Embodiments provide for expansion stress-relief to prevent cracking of the gripping elements during radial expansion. The disclosed embodiments can be applied along the length of existing expandable liner hangers, which typically have up to five axial load bearing assemblies, for example, each having an annular sealing member twelve inches long with four inch longitudinal spacing between assemblies. Variations will be recognized by those of skill in the art for varying element patterns and liner hanger structures.

While some current liner hanger elements partially derive their sealing and gripping ability from pressure internal to the liner hanger and/or external to the casing, the presently disclosed embodiments operate independently of these pressures to achieve greater axial load bearing capacity.

As radial expansion occurs, any material preferentially hardened to a shallow case depth will exhibit a tendency to crack. The embodiments provide stress-relief features to accommodate this phenomenon. The stress relief features do not significantly detract from the axial load bearing capacity achieved. The hardened metal materials and methods of application or manufacturing can vary and are known in the art, such as selectively applied, carburization, flame spray, micro-weld and grind, adding a binder, etc. Preferably, a hardened portion is hardened to a shallow case depth only. Hardened material can be selectively applied to the tool exterior, such as a tungsten-carbide in a nickel or cobalt binder metal applied by a flame spray, or a weld or micro-weld of sufficiently hard metal applied. The metal can be integral to the tool body and carburized, flame or induction hardened, etc., as is known in the art.

Representatively illustrated in FIG. 1 is an expandable liner hanger system 10 which embodies principles of the present invention. In this system 10, a casing string 12 has been installed and cemented within a wellbore 14. An expandable liner 16 is to be hung, extending downhole from a lower end of the casing string 12. An annulus 24 is created between the casing 12 and work string 22. The liner hanger can support additional wellbore casing, operational tubulars or tubing strings, completion strings, downhole tools, etc., for positioning at greater depths.

As used herein, the terms "liner," "casing," and "tubular" are used generally to describe tubular wellbore items, used for various purposes in wellbore operations. Liners, casings, and tubulars can be made from various materials (metal, plastic, composite, etc.), can be expanded or unexpanded as part of an installation procedure, and can be segmented or continuous. It is not necessary for a liner or casing to be cemented into position. Any type of liner, casing, or tubular may be used in keeping with the principles of the present invention.

As depicted in FIG. 1, an expandable liner hanger 18 is used to seal and secure an upper end of the liner 16 near a lower end of the casing string 12. Alternatively, the liner hanger 18 could be used to seal and secure the upper end of the liner 16 above a window (not shown) formed through a sidewall of the casing string 12, with the liner extending outwardly through the window into a branch or lateral wellbore. Thus, it will be appreciated that many different configurations and relative positions of the casing string 12 and liner 16 are possible in keeping with the principles of the invention.

A setting tool 20 is connected proximate the liner hanger 18 on the work string 22. The work string 22 is used to convey the setting tool 20, liner hanger 18, and liner 16 into the wellbore 14, conduct fluid pressure and flow, transmit torque, tensile and compressive force, etc. The setting tool 20 is used to facilitate conveyance and installation of the liner 16 and liner hanger 18, in part by using the torque, tensile, and compressive forces, fluid pressure and flow, etc., as delivered by the work string 22.

The expandable liner hanger 18 is shown with generic gripping and/or sealing members 26 positioned on and attached to the liner hanger 18. When the liner hanger 18 is expanded, such as with an expansion cone, into gripping and sealing engagement with the casing, the external gripping and sealing members 24 sealingly and grippingly engage the interior of the casing string 12. These elements are discussed more fully below.

It is specifically understood that the principles of the inventions are not limited to the details of the system 10 and associated methods described herein. Instead, it is clearly understood that the system 10, methods, and particular elements thereof, are examples of a wide variety of configurations, alternatives, etc., which may incorporate the principles of the invention.

Figure 2A:
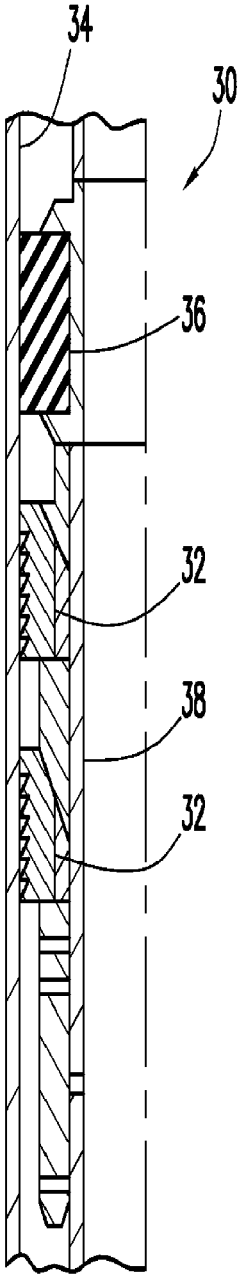
FIG. 2A (PRIOR ART)
FIGS. 2A-C are cross-sectional views of exemplary liner hangers having various gripping and sealing members typically used to hang the liner onto a casing.
Figure 2B:
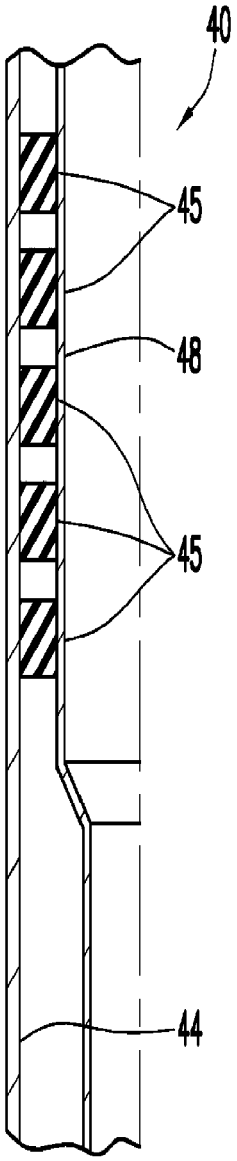
FIG. 2B (PRIOR ART)
Figure 2C:
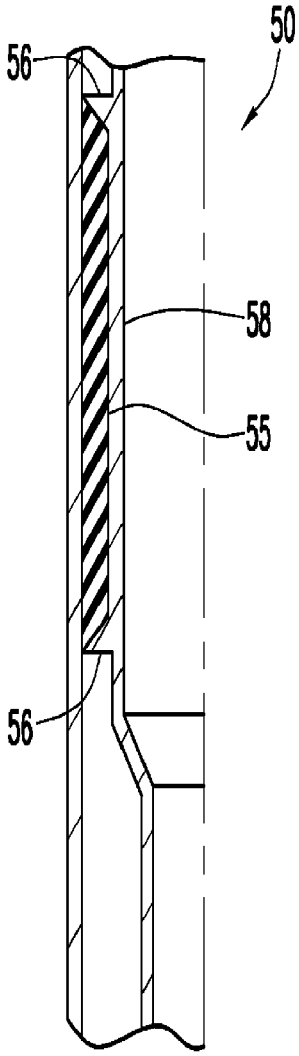
FIG. 2C (PRIOR ART)

FIGS. 2A-C are cross-sectional views of exemplary liner hangers having exemplary and various gripping and sealing members used to hang the liner onto another tubular, such as a casing. FIG. 2A shows a typical hanger design 30 utilizing mechanical slips 32 to grippingly engage the casing 34. Note that the gripping and sealing members are radially expandable, however, the liner hanger mandrel or tubular 38 is not. The slips 32 are segmented (as-assembled or upon radial expansion) to allow for radial expansion and engagement with the casing. The exemplary slips in the figure are present in two sets, upper and lower, both sets having tooth designs primarily for preventing slippage of the liner in one direction (namely, downhole, as shown). Other slip arrangements are known in the art, providing gripping engagement against both uphole and downhole movement (e.g., bi-directional teeth, multiple slips sets acting in opposite directions, etc.). The slips do not provide a fluid sealing function, which is instead performed by one or more annular sealing members 36, typically an elastomeric material. The sealing member is radially expanded and longitudinally reduced during the setting operation. In various designs, the sealing member 36 can be set in conjunction with setting of the slip(s) or independently. Further, various arrangements of slips and sealing members can be used, such as elastomeric sealing members sandwiched between multiple slips, between a slip and a support member, or with the sealing member on one side of all the slips (as in FIG. 2A). Finally, the sealing member can be set, or the setting enhanced, by use of swellable, inflatable, or other sealing member design.

FIG. 2B shows a typical expandable hanger design 40, wherein the hanger mandrel or tubular 48 is radially expanded during the setting process. The gripping and sealing members 45 are here reduced to single-element, dual-function components. That is, each element 45 both grippingly engages the casing 44 and sealingly engages the casing 44. The elements 45 are circumferentially continuous, or annular, and not segmented. Further, the radially expandable elements 45 are expanded in direct response to radial expansion of the mandrel 48 rather than in direct response to longitudinal movement of a setting tool. The exemplary elements 45 are seen used in conjunction with other such elements, here a set of five elements 45 on a single expandable liner hanger 40. In some instances, the element can be set, or setting can be enhanced, by use of swellable materials, etc.

FIG. 2C shows a particular element design 50, wherein the element 55 is "trapped" or buttressed by circumferential rings 56 defined on the tool mandrel 58. The element 55 can be elastomeric material. The circumferential rings can be integral to the mandrel or separately attached. The circumferential rings 56 have an outer diameter about the same as that of the element 55. The rings resist extrusion of the element 55 under high temperature and high pressure. This design is similar to that found in commercially available liner hangers from Halliburton Energy Services, Inc., under the trade name Versaflex.

FIGS. 3-6 illustrate exemplary embodiments of axial load bearing assemblies according to aspects of the disclosure. The disclosed assemblies are intended to increase axial load bearing capability over presently available assemblies of similar design with the placement of additional features for that purpose. The increase in axial load capacity aids in later-performed operations requiring compressive loading. The axial load bearing assemblies operate independently of external casing pressure and/or internal tubing pressure, unlike some currently available assemblies.

Prior art assemblies relying primarily or exclusively on the physical characteristics of one or more sealing members to perform a gripping function encounter difficulties, including designs having annular retainers positioned above and below the sealing member. While such designs achieve gripping and sealing functionality, they tend to be sensitive at elevated temperatures, where reduced friction and increased shearing of the sealing member can occur. The disclosed embodiments also avoid use of traditional "slips" which have known issues during run-in-hole (RIH) and in creating point loads once deployed. The present invention solves the problem of increased axial load capacity while not introducing these adverse side effects.

Further, a low equivalent circulating density (ECD) is maintained in the embodiments, as is the ability to reciprocate and rotate the work string during maneuvering in the wellbore (e.g., run-in-hole).

The embodiments each include hardened metal features, which undergo radial expansion during deployment. As radial expansion occurs, materials preferentially hardened to a shallow case depth exhibit a tendency to crack. The hardened gripping features shown are preferably an integral part of the liner hanger and, upon subsequently radially expansion, are thereby trapped between the expanded liner hanger and adjacent casing. The embodiments herein provide stress-relief features to accommodate this phenomenon. The stress-relief features do not substantially detract from the axial load holding capacity. The hardened metal materials and methods of application or manufacturing can vary and are known in the art (selectively applied, carburization, flame spray, micro-weld and grind, adding a binder, etc.).

Figure 3:
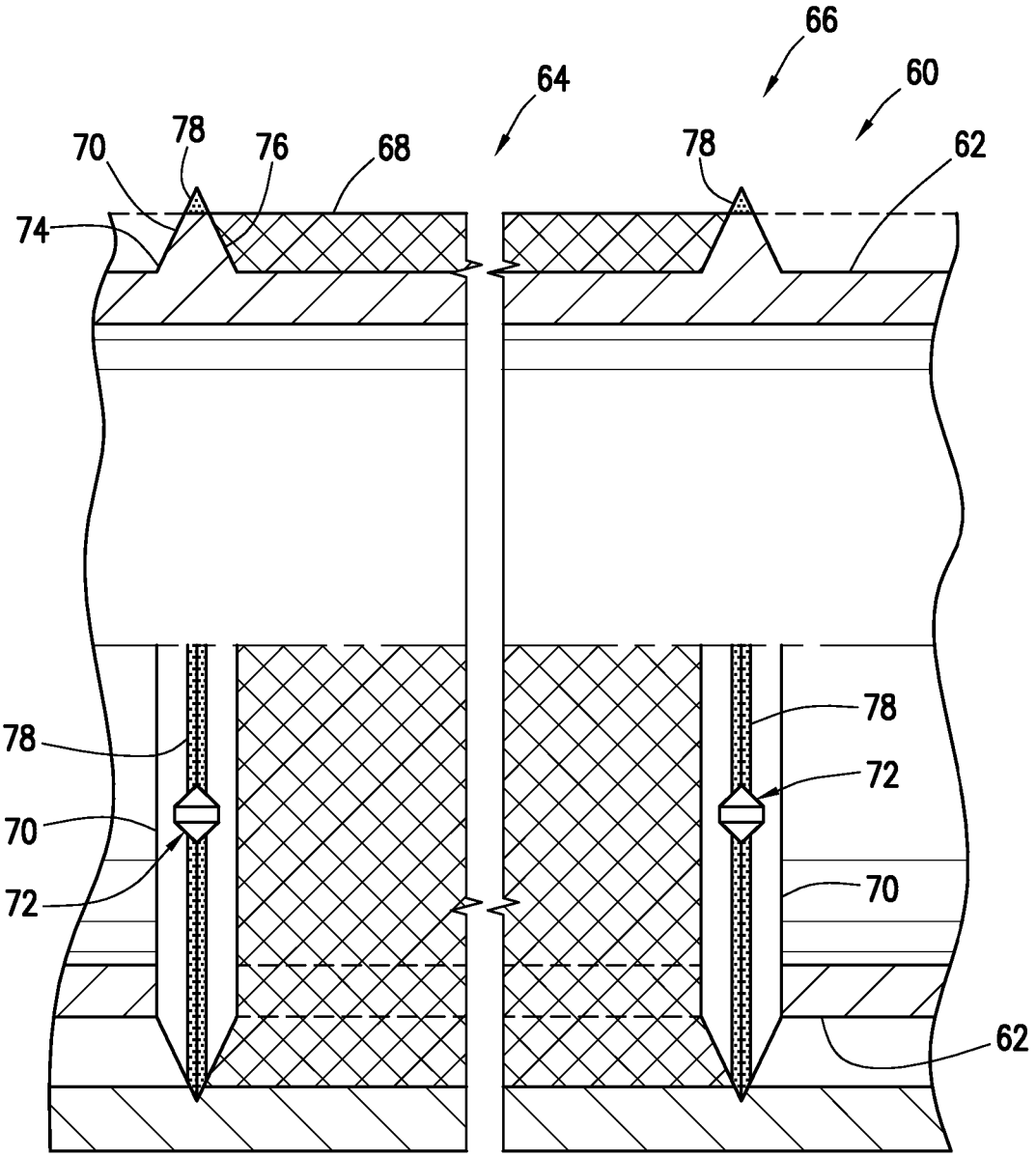
FIG. 3 is an elevational view with partial cut-away of a preferred embodiment of an exemplary axial load bearing assembly positioned on an expandable liner hanger according to an aspect of the invention.

Turning to the preferred embodiments, FIG. 3 is an elevational view, with cut-away and partial cross-section, of a preferred embodiment of an exemplary axial load bearing assembly on an expandable liner hanger according to an aspect of the invention. An exemplary axial load bearing assembly 60 is seen on an expandable liner hanger tubular 62 having a sealing sub-assembly 64 and a gripping sub-assembly 66. The embodiment increases axial loading capacity of the expandable liner hanger. Some existing designs use integral metal rings to trap elastomeric elements of varying length, which in turn exert a post-expansion normal force on the adjacent casing to achieve axial load capacity. Such designs rely extensively upon the mechanical properties of the elastomeric seals, which can be problematic, especially at elevated temperatures where such seals may yield, etc. The proposed design separates these functions such that the gripping and sealing functions are performed largely by separate sub-assemblies on an axial load bearing assembly.

The sealing sub-assembly 64 includes an annular sealing member 68 which is preferably elastomeric and more preferably a bonded elastomeric material. The sealing member is annular and positioned around the liner hanger tubular 62. In a preferred embodiment, the inner diameter of the sealing member 68 abuts the outer surface of the tubular 62. The sealing member preferably extends longitudinally about twelve inches, and multiple elements can be spaced longitudinally along the liner hanger tubular. The annular sealing member 68 performs a sealing function, once radially expanded, and provides an annular seal between the liner hanger and adjacent casing.

The gripping sub-assembly 66 seen in FIG. 3 is comprised of two circumferential, radially extending ridges or rings 70. In a preferred embodiment, the ridges 70 are circumferentially continuous; however, other arrangements will be apparent to those of skill in the art. The ridges each have a plurality of stress-relief features 72 defined thereon. Preferably, the stress-relief features are notches or cut-outs spaced circumferentially on the ridges 72, as shown. Those of skill in the art will recognize other stress-relief features and geometries as well.

Each ridge 70 defines opposing side walls 74 and 76. Preferably neither of these walls is perpendicular with respect to the tubular exterior surface. More preferably, the walls define between about a 45 to 60 degree angle with respect to the tubular surface. Each ridge 70 defines a substantially circumferential "tooth" 78 (or teeth) defined at its outer diameter. The tooth is hardened, such as by methods mentioned previously herein. More preferably, the tooth is carburized or induction hardened. The depth of hardening is preferably about 0.015 to 0.030 inches. The hardened tooth is preferably just deep enough for penetration of the casing. Preferably the circumferential ridges have an outer diameter slightly greater than that of the annular sealing member 66. More preferably the OD difference is about 0.015 to 0.030 inches or penetration depth. Preferably, the ridge OD is smaller than that of those of other string tools to avoid catching on internal features while running in the hole. The circumferentially extending tooth can be interrupted by stress relief features, as shown, which can be viewed as forming a plurality of "teeth."

Figure 4A:
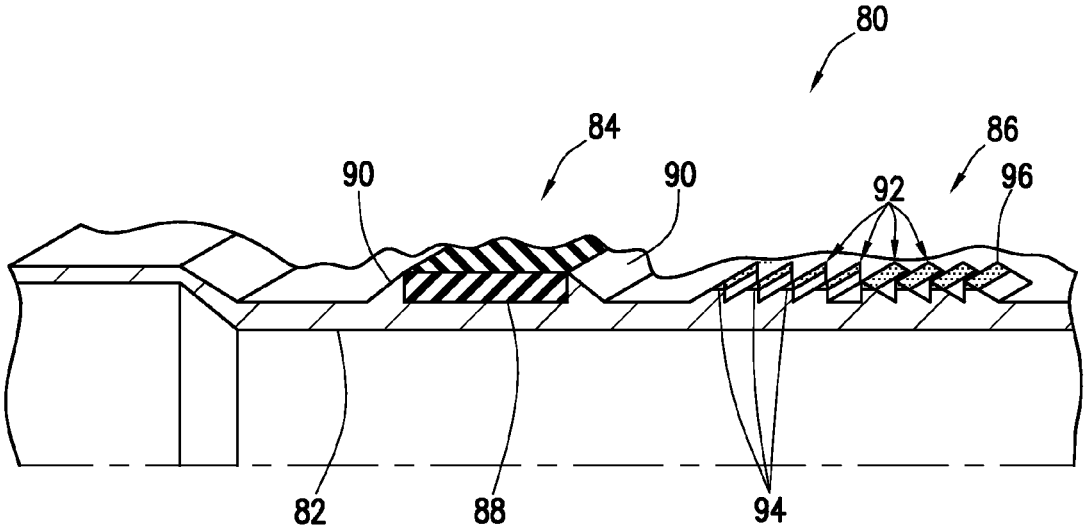
FIGS. 4A-B are longitudinal and axial cross-sectional views of one preferred embodiment of exemplary axial load bearing assembly on an expandable downhole tool assembly according to an aspect of the invention.
Figure 4B:
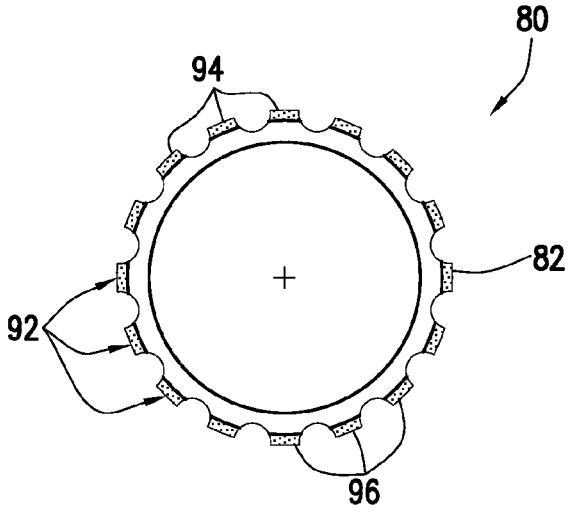

FIGS. 4A-B are longitudinal and axial cross-sectional views of a preferred embodiment of an exemplary axial load bearing assembly on an expandable liner hanger according to an aspect of the invention.

An expandable liner hanger 80 is seen having a tubular 82 with a sealing sub-assembly 84 and gripping sub-assembly 86. The sealing sub-assembly 84 includes at least an annular sealing member 88, preferably elastomeric and more preferably bonded elastomeric. The sealing member is preferably circumferentially bounded above and below by ridges 90. The ridges 90 can be as those described above with respect to FIG. 2, or can lack one or more of the features (hardened teeth, greater OD, and stress relief notches) described in the embodiment at FIG. 2. The ridges perform as an anti-extrusion features.

Proximate the sealing sub-assembly 84 is one or more gripping sub-assemblies 86, positioned above and/or below the sealing sub-assembly. The gripping sub-assembly 86 has a plurality of radially extending teeth 92, which are hardened, in whole or in part (e.g., the tip 94 of each tooth can be hardened in lieu of the entire tooth). The teeth can be uni-directional or bi-directional. Preferably, at least some of the plurality of teeth 92 are oriented to hold against downward axial load while others of the plurality of teeth 92 are oriented to hold against upward axial load. The teeth are spaced circumferentially around the exterior surface of the tubular and are preferably integral to the tubular. Various spacing schemes can be used. In a preferred embodiment, a plurality of circumferential ridges are provided, having expansion stress relief notches defined therein, as shown, with part or all of the ridge hardened. The teeth are preferably carburized and ground to create a hardened, radially outwardly facing upper surface 96. Preferably the teeth have an OD greater than that of the annular sealing member, and more preferably, defining an OD differential between the ridges and annular sealing member equal to a depth of tooth penetration.

Figure 5A:
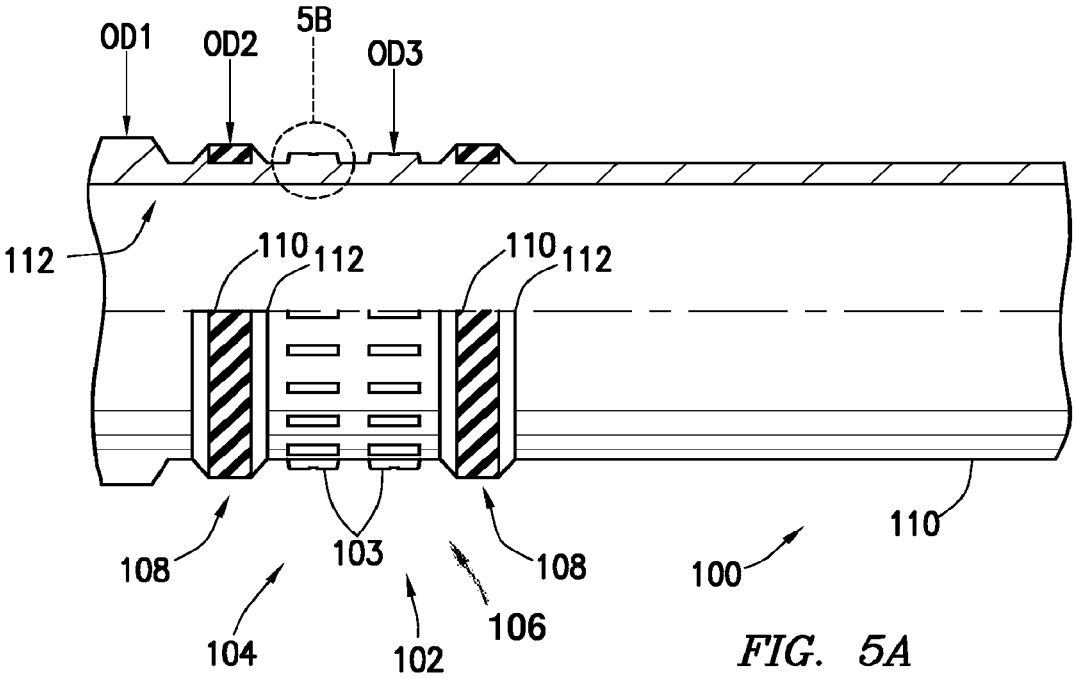
FIGS. 5A-B are an elevational schematic and a detail view of a preferred embodiment of an exemplary axial load bearing assembly on an expandable downhole tool assembly according to an aspect of the invention.
Figure 5B:
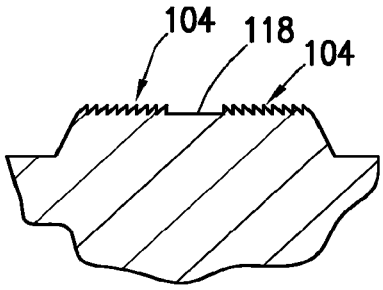

FIGS. 5A-B are a plan side view and detailed views of one preferred embodiment of an exemplary axial load bearing assembly on an expandable downhole tool assembly according to an aspect of the invention. FIG. 5A is an elevational schematic of an expandable liner hanger 100 having one or more gripping sub-assemblies 102 comprising a plurality circumferentially and/or longitudinally spaced ridges 103 positioned along the exterior surface of a liner hanger tubular 110. FIG. 5B is a detail view of a ridge having a plurality of teeth defined thereon.

As stated, FIG. 5A is an elevational schematic of an expandable liner hanger 100 having one or more gripping sub-assemblies 102 comprising a plurality circumferentially and/or longitudinally spaced ridges 103 positioned along the exterior surface of a liner hanger tubular 110. The ridges preferably extend longitudinally along the tubular. More than one set of ridges can be used, 104, 106, with sets utilizing differing anchoring patterns. Two exemplary patterns are shown. Two gripping sub-assemblies 102 are shown positioned between two sealing sub-assemblies 108. Other patterns and arrangements, relative positions and numbers of sub-assemblies, etc., will be apparent to those skilled in the art. The preferred sealing sub-assemblies 108 are similar to those described above, preferably having an annular sealing member 110 and circumferential ridges 112. A detailed description will not be repeated here.

Each of the ridges 103 has a "flat top" (radially outward facing surface) on which a plurality of case hardened teeth 104 are positioned, also extending radially, as best seen in FIG. 5B. The teeth are preferably case hardened and can be formed using a weld overlay of sufficiently hard metal material (e.g., at least 60 Rc). Case hardening provides for a greater hardness at the exterior surface of the teeth with decreasing hardness at greater depths down to the base material. The teeth can be ground or otherwise shaped as needed. Alternative hardening and manufacturing methods can be used. Further, the teeth are preferably provided with a plurality of teeth designed to hold against axial loads primarily in an upward direction, and a plurality of teeth designed to hold against axial loads primarily in a downward direction. In a preferred embodiment, the teeth are angled at a maximum of 30 degrees with respect to the tubular surface.

Also seen in FIG. 5A are relative outer diameters (OD) of various elements of the assembly. The ODs are exaggerated for purposes of explanation. The expandable liner hanger tubular 110, seen in an unexpanded state, includes a radially enlarged portion 112 having an $OD_1$, typically for the provision of an expansion cone or similar. The sealing sub-assembly $OD_2$ is smaller than that of the radially enlarged portion of the liner hanger tubular (prior to radial expansion). The gripping sub-assembly $OD_3$ is smaller than the $OD_2$ of the sealing sub-assembly (prior to expansion). Upon radial expansion, the OD of the annular sealing member sealingly engages the casing and the OD of the ridges (more specifically, the teeth thereon) grippingly engage the casing.

The ridges, as explained above, are preferably longitudinally extending. Such an arrangement better enables the hardened ridges and/or teeth to withstand the stresses of radial expansion without cracking or other undesired deformation. That is, the orientation acts as a stress relief feature.

Figure 6A:
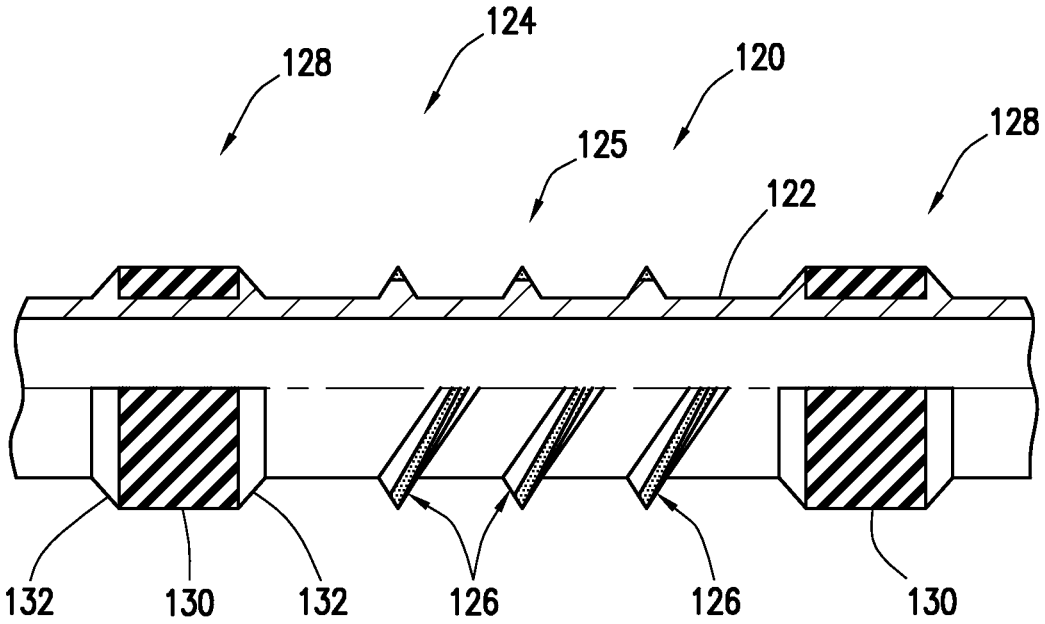
FIGS. 6A-B are an elevational schematic view and a flattened or "unwound" detail view of a preferred embodiment of an exemplary axial load bearing assembly on an expandable downhole tool assembly according to an aspect of the invention.
Figure 6B:
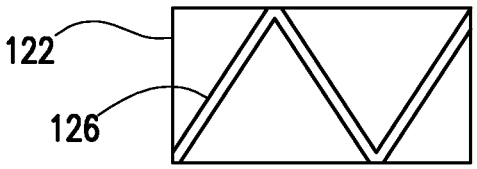

FIGS. 6A-B are an elevational schematic view and a flattened or "unwound" detail view of a preferred embodiment of an exemplary axial load bearing assembly on an expandable downhole tool assembly according to an aspect of the invention. Details of the embodiment are understood based on the descriptions elsewhere herein and will not be repeated. Where an angular pattern is used, increased axial loading is met with increased resistance.

The expandable liner hanger 120 has a mandrel 122 having one or more axial load bearing sub-assemblies 124 thereon. The exemplary sub-assembly has a plurality of gripping sub-assemblies 125 with circumferentially and longitudinally extending ridges 126, the ridges extending radially outward from the tubular. The ridges can be of any number, with an exemplary three ridges shown. Further, the gripping sub-assembly can be of various anchoring patterns within the spirit of the invention. For example, the anchoring pattern can describe chevrons (as shown), zigzags, undulations, arcs, etc. The ridges are preferably circumferentially continuous, although spacing can be interposed. Further, the ridges are metallic and preferably hardened or have hardened features as described above and, as necessary, employ stress relief features to assist during radial expansion. FIG. 6B shows an exemplary ridge pattern ("unwound" from the tubular).

The embodiment also includes one or more sealing sub-assemblies 128. The description above of exemplary sealing sub-assemblies applies here as well. The exemplary sealing sub-assemblies 128 have annular sealing members 130 and circumferential extrusion limiters or ridges 132.

For further disclosure regarding installation of a liner string in a wellbore casing, see U.S. Patent Application Publication No. 2011/0132622, to Moeller, which is incorporated herein in its entirety by reference for all purposes. For disclosure regarding expansion cone assemblies and their function, see, for example, U.S. Pat. No. 7,779,910, to Watson, which is incorporated herein by reference for all purposes; for further disclosure regarding hydraulic set liner hangers, see U.S. Pat. No. 6,318,472, to Rogers; also see PCT No. PCT/US12/58242, to Stautzenberger; all of which are incorporated herein in their entirety by reference for all purposes.

In preferred embodiments, the following methods are disclosed; the steps are not exclusive and can be combined in various ways. Further, additional steps and limitations are here listed, which can be performed in various order, omitted, or repeated. A method of placing a radially expandable tool having axial load bearing capability, once expanded, in a downhole tubular positioned in a subterranean wellbore, the method comprising the steps of: a) running-in a radially expandable tool having a gripping sub-assembly and a sealing sub-assembly; b) radially expanding the radially expandable tool, thereby c) grippingly engaging the downhole tubular with a plurality of radially extending ridges positioned on the exterior surface of the radially expandable tool by penetrating the downhole tubular with at least one hardened tooth extending from the ridges; d) sealingly engaging the sealing sub-assembly with the downhole tubular and sealing the annulus defined between the expandable tool and downhole tubular; and e) bearing an axial load placed on the expanded downhole tool.

The method can further comprise steps such as: radially expanding the radially expandable tool using a hydraulically powered expansion cone; and/or before step a), case hardening at least one tooth; case hardening further comprises carburizing, flame hardening, or induction hardening at least one tooth integral to the radially expandable tool; and/or wherein the step of case hardening further comprises welding, micro-welding, flame spraying, or applying a metal alloy onto the radially expandable tool; and/or wherein the plurality of ridges extend circumferentially around the radially expandable tubular; and/or wherein the at least one tooth extends circumferentially; and/or further comprising at least one radial expansion stress relief feature; and/or wherein the at least one radial expansion stress relief feature comprises at least one longitudinally extending notch defined in the at least one tooth or at least one ridge; and/or wherein the plurality of radially extending ridges extend circumferentially and longitudinally along the radially expandable tubular in an anchoring pattern; and/or wherein the plurality of ridges each define a relatively flat top surface, and wherein a plurality of teeth are defined on each relatively flat top surface. Other steps and orders of steps are apparent to one of skill in the art.

Exemplary methods of use of the invention are described, with the understanding that the invention is determined and limited only by the claims. Those of skill in the art will recognize additional steps, different order of steps, and that not all steps need be performed to practice the inventive methods described.

Persons of skill in the art will recognize various combinations and orders of the above described steps and details of the methods presented herein. While this invention has been described with reference to illustrative embodiments, this description is not intended to be construed in a limiting sense. Various modifications and combinations of the illustrative embodiments as well as other embodiments of the invention will be apparent to persons skilled in the art upon reference to the description. It is, therefore, intended that the appended claims encompass any such modifications or embodiments.

It is claimed:

1. A radially expandable downhole tool for bearing axial loads upon radial expansion into gripping and sealing engagement with a downhole tubular positioned in a subterranean wellbore, the tool comprising:

a radially expandable tubular defining an interior passageway and an exterior surface;

an axial load bearing assembly positioned on the exterior surface of the radially expandable tubular and having:

a gripping sub-assembly for, after the radial expansion, grippingly engaging the downhole tubular and bearing axial loads placed on the downhole tool, the gripping sub-assembly having a plurality of radially extending ridges, each ridge having at least one hardened tooth for penetrating into the downhole tubular and a plurality of longitudinally extending notches formed in the ridge and/or the at least one hardened tooth to relieve stress imparted by the radial expansion; and a sealing sub-assembly for, after the radial expansion, sealingly engaging the downhole tubular and sealing the annulus defined between the downhole tubular and the radially expandable downhole tool.

2. The tool of claim 1, wherein the at least one tooth is case hardened.

3. The tool of claim 2, wherein the at least one hardened tooth is provided by a method selected from the group consisting of: carburizing, flame hardening, induction hardening, and welding, micro-welding, flame spraying, or applying a metal alloy.

4. The tool of claim 2, wherein the at least one hardened tooth is a tungsten-carbide in a nickel or cobalt binder metal and applied by flame spray.

5. The tool of claim 1, wherein each of the plurality of ridges extends circumferentially around the radially expandable tubular.

6. The tool of claim 5, wherein each ridge defines at least one hardened tooth at its outer diameter.

7. The tool of claim 6, wherein the at least one tooth extends circumferentially.

8. The tool of claim 1, wherein the plurality of ridges has an outer diameter greater than the outer diameter of the sealing sub-assembly.

9. The tool of claim 1, wherein the plurality of radially extending ridges extend circumferentially and longitudinally along the radially expandable tubular in an anchoring pattern.

10. The tool of claim 9, wherein the anchoring pattern describes chevrons, zigzags, undulations, or arcs.

11. The tool of claim 1, wherein each of the plurality of radially extending ridges extends longitudinally along the radially expandable tubular, and wherein the plurality of ridges are arranged in an anchoring pattern.

12. The tool of claim 1, wherein each of the plurality of radially extending ridges define a relatively flat top surface, and wherein a plurality of teeth are defined on each relatively flat top surface.

13. The tool of claim 1, wherein the at least one hardened tooth defines two side walls, at least one of which is positioned at an angle of between 30 and 60 degrees with respect to the radially expandable tubular exterior surface.

14. The tool of claim 1, wherein the sealing sub-assembly further comprises: at least one annular sealing member, each annular sealing member being circumferentially bounded by ridges.

15. A method of placing a radially expandable tool having axial load bearing capability, once expanded, in a downhole tubular positioned in a subterranean wellbore, the method comprising the steps of:

a. running-in a radially expandable tool having a gripping sub-assembly and a sealing sub-assembly;

b. radially expanding the radially expandable tool, thereby c. grippingly engaging the downhole tubular with a plurality of radially extending ridges positioned on the exterior surface of the radially expandable tool by penetrating the downhole tubular with at least one hardened tooth extending from the ridges, wherein a plurality of longitudinally extending notches are formed in the ridge and/or the at least one hardened tooth to relieve stress imparted by the radial expansion;

d. sealingly engaging the sealing sub-assembly with the downhole tubular to seal the annulus defined between the expandable tool and downhole tubular; and e. bearing an axial load placed on the expanded downhole tool.

16. The method of claim 15, wherein step b) further comprises radially expanding the radially expandable tool using a hydraulically powered expansion cone.

17. The method of claim 15, further comprising, before step a), case hardening at least one tooth.

18. The method of claim 17, wherein the step of case hardening further comprises carburizing, flame hardening, or induction hardening at least one tooth integral to the radially expandable tool.

19. The method of claim 15, wherein the sealing sub-assembly of step d) comprises at least one annular sealing member, each annular sealing member being circumferentially bounded by ridges.

* * * * *